US010561189B2

(12) United States Patent
Lee

(10) Patent No.: US 10,561,189 B2
(45) Date of Patent: Feb. 18, 2020

(54) PROTECTIVE HEADGEAR

(71) Applicant: Choon Kee Lee, Denver, CO (US)

(72) Inventor: Choon Kee Lee, Denver, CO (US)

( * ) Notice: Subject to any disclaimer, the term of this patent is extended or adjusted under 35 U.S.C. 154(b) by 282 days.

(21) Appl. No.: 15/833,882

(22) Filed: Dec. 6, 2017

(65) Prior Publication Data

US 2019/0166943 A1 Jun. 6, 2019

(51) Int. Cl.

| | |
|---|---|
| ***A42B 3/06*** | (2006.01) |
| ***A63B 71/10*** | (2006.01) |
| ***A42B 3/28*** | (2006.01) |
| ***A42B 3/12*** | (2006.01) |
| *A42B 3/14* | (2006.01) |

(52) U.S. Cl.

CPC ..... *A42B 3/063* (2013.01); *A42B 3/121* (2013.01); *A42B 3/124* (2013.01); *A42B 3/28* (2013.01); *A63B 71/10* (2013.01); *A42B 3/122* (2013.01); *A42B 3/145* (2013.01)

(58) Field of Classification Search

CPC ..... A42B 3/063; A42B 3/121; A42B 3/124; A42B 3/28

USPC ..... 2/413

See application file for complete search history.

(56) References Cited

U.S. PATENT DOCUMENTS

| | | | |
|---|---|---|---|
| 4,213,202 | A | 7/1980 | Larry |
| 4,375,108 | A | 3/1983 | Gooding |
| 4,484,364 | A | 11/1984 | Mitchell et al. |
| 4,564,959 | A | 1/1986 | Zahn |
| 4,566,137 | A | 1/1986 | Gooding |
| 4,985,931 | A | 1/1991 | Wingo, Jr. |
| 5,517,698 | A | 5/1996 | Nault et al. |
| 6,055,675 | A | 5/2000 | Egger et al. |
| 6,070,905 | A | 6/2000 | Renault |
| 6,105,176 | A | 8/2000 | Egger |
| 6,122,785 | A | 9/2000 | Bondie et al. |
| 6,317,896 | B1 | 11/2001 | Timms et al. |
| 6,446,270 | B1 | 9/2002 | Durr |
| 6,658,671 | B1 | 12/2003 | Von Holst et al. |
| 6,839,910 | B2 | 1/2005 | Morrow et al. |
| 6,931,671 | B2 | 8/2005 | Skiba |
| 7,802,320 | B2 | 9/2010 | Morgan |
| 7,832,023 | B2 | 11/2010 | Crisco |
| 7,904,971 | B2 | 3/2011 | Doria et al. |
| 7,930,771 | B2 | 4/2011 | Depreitere et al. |
| 8,566,968 | B2 | 10/2013 | Marzec et al. |
| 8,615,817 | B2 | 12/2013 | Phillips |
| 8,683,617 | B2 | 4/2014 | Chilson et al. |
| 8,756,719 | B2 | 6/2014 | Veazie |
| 8,904,584 | B2 | 12/2014 | Sugano et al. |
| 8,955,169 | B2 | 2/2015 | Weber et al. |
| 8,973,171 | B2 | 3/2015 | Cleva |
| 9,131,743 | B2 | 9/2015 | Marzec et al. |

(Continued)

*Primary Examiner* — Gloria M Hale

(57) ABSTRACT

The present invention provides a protective headgear having a multi-layered shell to sequentially extend time of collision of a blunt trauma to a human head and to differentially release an average impact force of the collision to the human head wearing the protective headgear across a mid layer of the multi-layered shell. The mid layer is configured to separate centripetal mechanical waves of the collision from centrifugal mechanical waves of the collision in phase with the centripetal mechanical waves so as to reduce summation of in-phase bidirectional mechanical waves of bidirectional mechanical forces upon the collision.

13 Claims, 12 Drawing Sheets

(56) References Cited

U.S. PATENT DOCUMENTS

| | | | | |
|---|---|---|---|---|
| 9,220,311 | B1 | 12/2015 | Baldi | |
| 9,332,800 | B2 | 5/2016 | Brown | |
| 9,408,423 | B2 | 8/2016 | Guerra | |
| 10,212,980 | B2 * | 2/2019 | Lee | A42B 3/121 |
| 10,219,574 | B2 * | 3/2019 | Lee | A42B 3/122 |
| 10,433,610 | B2 * | 10/2019 | Lee | A42B 3/063 |
| 2003/0139104 | A1 | 7/2003 | Arai | |
| 2003/0140400 | A1 | 7/2003 | Ho | |
| 2003/0180517 | A1 | 9/2003 | Karall | |
| 2005/0196592 | A1 | 9/2005 | Tao et al. | |
| 2006/0137073 | A1 | 6/2006 | Crisco | |
| 2006/0248630 | A1 | 11/2006 | Bullock et al. | |
| 2008/0120764 | A1 | 5/2008 | Sajic | |
| 2009/0266663 | A1 | 10/2009 | Lin | |
| 2010/0000009 | A1 | 1/2010 | Morgan | |
| 2010/0299812 | A1 | 12/2010 | Maddux et al. | |
| 2011/0047678 | A1 | 3/2011 | Barth et al. | |
| 2012/0060251 | A1 | 3/2012 | Schimpf | |
| 2012/0151664 | A1 | 6/2012 | Kirshon | |
| 2012/0198604 | A1 | 8/2012 | Weber et al. | |
| 2013/0061375 | A1 | 3/2013 | Bologna et al. | |
| 2013/0152287 | A1 | 6/2013 | Cormier et al. | |
| 2013/0185837 | A1 | 7/2013 | Phipps et al. | |
| 2014/0013492 | A1 | 1/2014 | Bottlang et al. | |
| 2014/0053323 | A1 | 2/2014 | Marzec et al. | |
| 2014/0208486 | A1 | 7/2014 | Krueger | |
| 2015/0157083 | A1 | 6/2015 | Lowe | |
| 2015/0264991 | A1 | 9/2015 | Frey | |
| 2015/0305427 | A1 | 10/2015 | Prabhu et al. | |
| 2017/0280813 | A1 * | 10/2017 | Lee | A42B 3/121 |
| 2017/0367431 | A1 * | 12/2017 | Lee | A42B 3/122 |
| 2018/0092421 | A1 * | 4/2018 | Lee | A42B 3/063 |
| 2019/0110545 | A1 * | 4/2019 | Lee | A42B 3/063 |
| 2019/0142099 | A1 * | 5/2019 | Lee | A42B 3/125 2/412 |
| 2019/0166943 | A1 * | 6/2019 | Lee | A42B 3/063 |

* cited by examiner

PROTECTIVE HEADGEAR

TECHNICAL FIELD

The present invention relates generally to the field of protecting a human brain upon a collision with a colliding source. More specifically, the present invention provides a headgear to reduce an average impact force of the collision to the human brain.

BACKGROUND OF THE INVENTION

Boundary effect of mechanical waves of a blunt trauma can be exploited for reducing amplitude of the mechanical waves delivered to a brain tissue, using a multi-layered protective shell to increase number of boundaries inside the protective shell of a protective headgear as practically many as possible to a point there would not be a serious tissue injury to the brain tissue. Separately in a model of a two-layer medium panel with a first layer adjoining a second layer without a gap, it is known that there is no phase change at a boundary between the first layer and the second layer having a lower hardness than that of the first layer in reflected mechanical waves from incident mechanical waves traveling from the first layer to the second layer. Combination of both the incident and reflected mechanical waves in phase with each other temporarily increases an amplitude of the incident mechanical waves which increases an amplitude of transmitted mechanical waves in the second layer from the incident mechanical waves. If a series of the incident mechanical waves impacts the first layer, an amplitude of the reflected mechanical waves off the boundary merges with an amplitude of successive mechanical waves following a first wave of the mechanical waves coming toward the first layer. The amplitude of the successive mechanical waves following the first wave of the mechanical waves temporarily increases upon the addition of the amplitude of the reflected mechanical waves in phase with the successive mechanical waves, which increases a magnitude of an impact of the successive mechanical waves following the first wave of the mechanical waves to the second layer. If the first layer is made of a material that has a lower hardness than that of the second layer, the reflected mechanical waves off the boundary between the first and the second layers from the first wave reverse the phase and merge with the successive mechanical waves coming toward the first layer in a way the amplitude of the successive mechanical waves decreases. It results in a reduction of the magnitude of the impact of the successive mechanical waves to the second layer.

Intensity of an incident mechanical force of collision delivered to the brain tissue depends on a mass (weight) of a source moving to the brain tissue of a victim, generating the incident mechanical force from a velocity of an impact from the source multiplied by a mass (weight) of the victim and a stopping distance of the impact by the victim colliding with the source: $KE=\frac{1}{2}\times mv^2$ where KE is kinetic energy before an impact, m is mass in kg and v is velocity in meter/second. Separately, time (duration) of the impact of the incident mechanical force on the brain tissue is another factor determining an extent of damage to the brain tissue. This entity, "Impulse of force" follows Newton's second law, i.e., $F_{average}$ (Average impact force)=mass×change in velocity during collision/change in time of collision, and is found to be equal to a change in momentum of the victim provided that the mass is constant. In a scenario of an impact by a moving source to the brain tissue where the change in momentum (Impulse of force) is fixed, and the impact stops the moving source, extending the time (duration) of the collision decreases a time average of the average impact force. Similarly, based on the work-energy principle, i.e., $F_{average}$ (Average impact force)×d (distance)=−½×mass×velocity$^2$, extending distance moved during the collision reduces the average impact force. Since the stopping distance of the impact by the victim is a relatively fixed value and the velocity of the impact from the source could be a relatively fixed value depending on a type of collision, we need to substantially increase size of a protective headgear to achieve a meaningful reduction in the average impact force to the brain tissue of the victim, if we use the distance as a factor to reduce the average impact force. However, the time of the collision can be practically extensible with a time-delay device for the impact, without a need to substantially enlarge the size of the protective headgear. One such device is a pressurizable and ventable sac surrounding the multi-layered shell of the protective headgear (US 20170280813 A1), which releases a pressurized gas from the sac upon the collision over a certain period of time. An analogous mechanistic example can be found in a car tire that is fully inflated with a gas under pressure and is releasing the gas through a nail puncture hole each time the tire runs over bumps of rough patches of a road. Releasing the pressurized gas upon each collision with the bumps, the tire continues to absorb an impact from the collision until the pressurized gas gets depleted from the tire. Not only is the time of the collision extended by the pressurized gas inside the tire, but also a part of the average impact force is released along with a portion of the pressurized gas that is vented through the nail hole upon the collision.

In a system comprising a plurality of concentric layers for the multi-layered shell of the protective headgear, efficiency in reduction of the average impact force can be enhanced further by sequential release of the average impact force by an individual concentric layer of the multi-layered shell. A basic motif of the multi-layered shell for the sequential release of the average impact force comprises an outer layer, a mid layer and an inner layer. The mid layer is configured to be undeformable, and to serve as a separating barrier of a centripetal incident mechanical force of a colliding source from a centrifugal incident mechanical force from the victim's head. The mid layer comprises an outer ply of a hard thermoplastic polymer, a mid ply of a compressible polymer foam and an inner ply of a hard thermoplastic polymer. The outer layer comprises a pressurizable and ventable sac in a hemispherical bowl configuration having a compressible and deformable polymer filling up inside the pressurizable and ventable sac. The compressible and deformable polymer includes a structured configuration such as concentrically stacked-up polymer tubes, and an unstructured configuration such as an open-cell polymer foam. The outer layer having a pressurized gas inside is configured to vent the pressurized gas upon a collision through a plurality of valves that have a range of threshold pressure for venting. The inner layer comprises a plurality of compressible and deformable blocks made of polymer foams, with each block enclosed tightly by an outer membrane. The outer membrane is configured with a plurality of holes through which air passively moves in and out of the block upon decompression and compression of the block, respectively. The inner layer is configured to encircle the victim's head and to be centrifugally compressed by the centrifugal incident mechanical force from the victim's head upon the collision. Upon the collision with the colliding source having the centripetal incident mechanical force, the outer layer is configured to complete venting of the pressurized gas before the inner layer is fully compressed by the centrifugal incident mechanical force from the victim's head. In this sequence, a portion of the average impact force from the centripetal incident mechanical force is released from the outer layer over an extended time while the inner layer continues to release a portion of the average impact force from the centrifugal incident mechanical force beyond the extended time for the outer layer. This two-step staggered sequence of extension of time of the collision and differential release of the average impact force amplify reduction of the average impact force and help reduce summation of bidirectional incident mechanical forces inside the brain tissue, respectively.

SUMMARY OF THE INVENTION

In an effort to increase efficiency in reduction of an average impact force of a collision from a colliding source to a head wearing a protective headgear, the present invention provides a protective headgear having a three-layered shell which comprises an outer layer having a pressurizable and ventable sac in a hemispherical bowl shape, an undeformable mid layer, and an inner layer. All three layers except the mid layer are to an extent compressible and depressibly deformable by an impact of the collision at an angle to a planar surface of each layer. The pressurizable and ventable sac of the outer layer is configured to vent out a portion of a pressurized gas inside the pressurizable and ventable sac upon the collision of the colliding source to the protective headgear. The inner layer is configured to be passively compressed and deformed by the head moving centrifugally upon the collision with the colliding source. Time to complete passive compression of the inner layer is configured to last longer than time to complete venting out the portion of the pressurized gas from the outer layer.

In one embodiment, the pressurizable and ventable sac comprises a dome configured in a substantially hemispherical bowl shape and a ballooned rim adjoining a lower circumferential margin of the dome. The pressurizable and ventable sac is airtight and inflatable by the pressurized gas, and has a pressurized-gas intake valve located on a lower surface of a posterior ballooned rim and a group of pressure-triggerable gas release valves located on the lower surface of the ballooned rim along the circumference of the ballooned rim. On a side of an outer surface of the ballooned rim, the pressure sensor device having the alarm function of the sound alarm and flashing lights is installed, which measures an internal pressure of the pressurizable and ventable sac. The dome and the adjoining ballooned rim are configured to slidably enclose the mid layer. The pressurizable and ventable sac is made of a thermoplastic elastomer such as polyurethane elastomer, high-density polyethylene based elastomer or polyamide based elastomer which withstands a range of internal pressure of the pressurizable and ventable sac above an atmospheric pressure over a range of temperature from 0° F. to 175° F. without material failure.

In one embodiment, the pressurizable and ventable sac comprises a polymeric filling having a compressible and deformable open-cell polymer foam filling up inside the pressurizable and ventable sac. The compressible and deformable open-cell polymer foam is provided in a hemispherical bowl shape, comprising an outer panel having a smooth contour fixedly adjoining an inner panel having a plurality of planar tiles arranged in a criss-cross tiled configuration. The outer panel and the planar tiles of the inner panel of the compressible and deformable open-cell polymer foam are fixedly and air-tightly enveloped by an outer membrane of the pressurizable and ventable sac. The compressible and deformable open-cell polymer foam air-tightly enveloped by the outer membrane is configured to be distensible upon insufflation of a pressurized gas into the pressurizable and ventable sac. A boundary between two adjacent planar tiles of the inner panel comprises a linear groove disposed in between two adjacent planar tiles. The linear groove is configured to fixedly mate with and adhere to a polygonal grid in a way that the polygonal grid is fixedly inserted in between the inner panel and the outer envelope. Examples of the open-cell polymer foam include open-cell polyester-urethane foams, open-cell polyurethane foams, open-cell polyolefin foams, and open-cell polyethylene foams. The open-cell polymer foam has a 25% indentation force deflection value of higher than 45 and a foam support factor of between 1.5 and 3.0. The open-cell polymer foam is configured to have a hardness of a Shore D scale value of at least 10 below the Shore D scale value of the inner layer.

In one embodiment, the polygonal grid comprises a plurality of polygons in a configuration of a hemispherical polyhedron, and is made of a thermoplastic polymer such as polyvinyl chloride, thermoplastic polyurethanes, polybutadiene, or polyethylene. The thermoplastic polymer of the polygonal grid has a Rockwell R hardness value ranging from 70 to 140. The Rockwell R hardness value of the thermoplastic polymer of the polygonal grid is configured to be lower than that of the mid layer. A plurality of the polygons adjoin each other along a border between two adjacent polygons, wherein the border between the two adjacent polygons of the hemispherical polyhedron is configured to be raised to form an outwardly protruding ridge which serves as a point of reflection of an incident mechanical force having incident mechanical waves. Four sides of the protruding ridges are perforated with holes so as to vent the pressurized gas from the compressible and deformable open-cell polymer foam through the holes.

In one embodiment, the pressurizable and ventable sac encloses a polymeric filling in a configuration of concentrically stacked-up tubes. A polymer tube comprises an open end on each side of the polymer tube of a length, is configured to be circumferentially compressible and deformable by an external pressure. The polymer tube is also configured to be distensible by a pressurized gas insufflated into the polymer tube. The concentrically stacked-up polymer tubes are arranged in a way each polymer tube adjoins the other polymer tube in parallel along a longitudinal axis of the polymer tube. Longitudinal axes of the polymer tubes are configured to be in parallel with a circumference of the hemispherical bowl configuration of the pressurized and ventable sac. Furthermore, the polymer tube is configured to be longitudinally placed, having one open end of a first polymer tube placed next to the other open end of a second polymer tube coaxially along the longitudinal axis of the polymer tubes. A gap is provided in between two open ends of the polymer tubes placed next to each other, so as to serve as ventable conduit for the pressurized gas. The concentrically stacked-up polymer tubes are arranged in a configuration of an outer panel adjoining an inner panel having a plurality of planar tiles arranged in a criss-cross tiled configuration. The outer panel and the planar tiles of the inner panel of the concentrically stacked-up polymer tubes are fixedly and air-tightly enveloped by an outer membrane of the pressurizable and ventable sac. The concentrically stacked-up polymer tubes air-tightly enveloped by the outer membrane is configured to be distensible upon insufflation of a pressurized gas into the pressurizable and ventable sac. A boundary between two adjacent planar tiles of the inner panel comprises a linear groove disposed in between two adjacent planar tiles. The linear groove is configured to fixedly mate with and adhere to the polygonal grid in a way that the polygonal grid is fixedly inserted in between the inner panel and the outer envelope. The pressurizable and ventable sac having the concentrically stacked-up polymer tubes fully inflated at a maximum pressure with the pressurized gas is configured to have a hardness of a Shore D scale value of between 65 and 90. Examples of the polymer tubes include polyolefin, polyethylene, polyvinyl chloride, thermoplastic polyurethanes, or polybutadiene.

In one embodiment, the pressurized-gas intake valve has a configuration of Schrader-type valve for pressurized gas embedded inside the lower surface of the posterior ballooned rim with an opening of the pressurized-gas intake valve disposed on the lower surface, without protruding parts beyond the lower surface. In one embodiment, a pressure-triggerable gas release valve is configured in a spring-operated pressure release valve which is a quick release valve. The spring is configured as compression spring which provides a range of resistance to an axial compressive pressure of the pressurized gas up to a predetermined set pressure limit beyond which the spring yields to the axial compressive pressure. The pressure-triggerable gas release valves are embedded inside the lower surface of the circumference of the ballooned rim in a way at least one gas vent is assigned to each anatomic region of the head, which is to facilitate release of the pressurized gas from the impacted region of the head to the nearest pressure-triggerable gas release valve without dissemination of the pressurized gas around an internal space of the pressurizable and ventable sac.

In one embodiment, the pressure-triggerable gas release valve in a closed configuration is to retain the pressurized gas up to a set limit of a pressure of the pressurized gas inside the pressurizable and ventable sac fully inflated with the pressurized gas. A collision of the pressurizable and ventable sac with a colliding source centripetally compresses the pressurizable and ventable sac, thereby decreasing an inner volume of the pressurizable and ventable sac. The decrease in the inner volume of the pressurizable and ventable sac increases the pressure of the pressurized gas inside the pressurizable and ventable sac, resulting in a release of a portion of the pressurized gas through the pressure-triggerable gas release valve once the pressure of the pressurized gas exceeds the set limit of the pressure governed by the resistance of the compression spring of the pressure-triggerable gas release valve. Subsequently the pressure of the pressurized gas decreases to below the set limit of the pressure of the pressurized gas following the release of the portion of the pressurized gas, the pressurized-gas intake valve returns back to the closed configuration as the resistance of the compression spring exceeds the pressure of the pressurized gas.

In one embodiment, time to complete the release of the portion of the pressurized gas through the pressure-triggerable gas release valve to below the set limit of the pressure of the pressurized gas by the centripetal incident mechanical force from the colliding source depends on a rate of release of the pressurized gas from the pressurizable and ventable sac. If a number of the pressure-triggerable gas release valve remains constant for a given centripetal incident mechanical force, the rate of release of the pressurized gas is dependent on a level of the resistance of the compression spring of the pressure-triggerable gas release valve. Since the time to complete the release of the pressurized gas translates to "time (duration) of collision", the time (duration) of collision can be regulated (i.e., extended) by the level of the resistance of the compression spring of the pressure-triggerable gas release valve. A pressure-triggerable gas release valve with a higher resistance of the compression spring takes a longer time of collision than a pressure-triggerable gas release valve with a lower resistance of the compression spring. If the resistance of the compression spring of the pressure-triggerable gas release valve remains constant, number of the pressure-triggerable gas release valves becomes a changeable factor for the rate of the release of the pressurized gas. More pressure-triggerable gas release valves per the pressurizable and ventable sac release faster the pressurized gas than less pressure-triggerable gas release valves.

In one embodiment, the mid layer is provided as three-ply layer in a hemispherically bowl configuration having an outer ply made of a hard polymer, an inner ply of the hard polymer, and a mid ply of a polymer foam that has a lower hardness than that of the outer and inner plies. Insertion of the polymer foam for the mid ply is configured to induce phase reversal of transmitted mechanical waves through the outer and inner plies to the mid ply. Examples of the hard polymer include polycarbonate, ethylene propylene diene, fluropolymers, or styrene-butadiene-styrene block copolymer. The three plies are fixedly bonded together to let the mid layer have a Rockwell R value of higher than 140 so as to withstand a collision without deformation of a planar surface of the mid layer over a gravitational force up to 300 g±30 g (10% S.D.) and over a range of temperature from 0° F. to 175° F. without material failure. An outer surface of the outer ply is configured to be fixedly adherent to an inner surface of the pressurizable and ventable sac, and an inner surface of the third ply is configured to reversibly enclose the inner layer of the three-layered shell.

In one embodiment, the mid layer is provided as a linearly corrugated plate in a hemispherical bowl configuration having a plurality of longitudinal ridges and furrows disposed on a planar surface of each ply of the mid layer. According to Huygens' principle, the incident mechanical waves of the incident mechanical force are reflected spherically in a centrifugal direction away from a border of a structure. Placement of multiple linear ridges on an outer surface of the mid layer in the hemispherically bowl configuration is intended to generate multiple spherical reflection points of bidirectional transmitted mechanical waves of a transmitted mechanical force, which promotes dissipation of the transmitted mechanical waves. Generation of centrifugal reflected mechanical waves of a centrifugal reflected mechanical force in a reverse phase to a phase of centripetal transmitted mechanical waves of a centripetal transmitted mechanical force emanating from the colliding source occurs on ridges disposed on an outer surface of the third ply since the mid ply has a lower hardness than that of the third ply. The centrifugal reflected mechanical waves of the centrifugal reflected mechanical force in the reverse phase merge with successive centripetal transmitted mechanical waves of the centripetal transmitted mechanical force, thereby reducing an amplitude of the successive transmitted mechanical waves of the transmitted mechanical force. On the other hand, generation of centripetal reflected mechanical waves of a centripetal reflected mechanical force in a reverse phase to a phase of centrifugal transmitted mechanical waves of a centrifugal transmitted mechanical force emanating from the head of a victim of the collision occurs on ridges disposed on an inner surface of the first ply since the mid ply has a lower hardness than that of the first ply. The linearly corrugated plate configuration of the three-ply layer of the mid layer serves to separate the centripetal mechanical waves from the centrifugal mechanical waves in phase with the centripetal mechanical waves so as to reduce summation of in-phase bidirectional mechanical waves of bidirectional mechanical forces upon the collision. Efficiency in the reduction depends on material characteristics of the polymer foam of the mid ply. Examples of the polymer foam include polyolefin foams, polyethylene foams, polystyrene foams, and flexible polyurethane foams. Viscoelastic urethane such as sorbothane could also be used for the mid ply.

In one embodiment, the inner layer, provided over a range of cross-sectional thickness and density, is made of a open cell polymer foam so as to release a portion of trapped air inside the open cell polymer foam to an ambient air upon a centrifugal incident mechanical force coming from the victim's head on a collision with the colliding source. Examples of the polymer foam include open-cell polyester-urethane foams, open-cell polyurethane foams, open-cell polyolefin foams, and open-cell polyethylene foams. Each block of the inner layer comprises an outer panel fixedly adjoining an inner panel. The polymer foam for the outer panel has a 25% indentation force deflection value of higher than 45 and a foam support factor of between 1.5 and 3.0. The polymer foam for the inner panel has a 25% indentation force deflection value of higher than 45 and a foam support factor of higher than 3.0. The inner panel is configured to have a hardness of a Shore D scale value of between 65 and 90, and the Shore D scale value of the outer panel is configured to be at least 10 below the Shore D scale value of the inner panel. The inner layer is configured to encircle the victim's head and to be centrifugally compressible by the centrifugal incident mechanical force from the victim's head upon the collision. The inner layer comprises a plurality of compressible and deformable blocks of the open-cell polymer foams, with each block enclosed tightly by an outer membrane. An outer surface of the outer membrane of the block is configured to be reversibly adhered to the inner surface of the third ply of the mid layer.

In one embodiment, the outer membrane of the block of the inner layer is configured with a plurality of air-release pin holes through which air passively moves in and out of the block upon decompression and compression of the block, respectively. Time to complete compression of the polymer foam of the block to a flattened configuration of the block by the centrifugal incident mechanical force from the victim's head depends on a rate of release of the trapped air from the polymer foam of the block through the air-release pin holes. If a size of the air-release pin hole remains constant for a given centrifugal incident mechanical force, the rate of release of the trapped air is dependent on a number of the air-release pin holes on the outer membrane of the block. Since the time to complete the compression of the polymer foam of the block translates to "time (duration) of collision", the time (duration) of collision can be regulated (i.e., extended) by a range of the number of the air-release pin holes on the outer membrane of the block. A block with less air-release pin holes takes a longer time of collision than a block with more air-release pin holes upon the collision.

In one embodiment, the three-layered shell of the present invention is configured to complete the release of a portion of the pressurized gas from the pressurizable and ventable sac over a time of collision with a colliding source before completion of the release of the trapped air from the polymer foam of the block of the inner layer over a time of collision with a victim's head. A main aim of the configuration of differential release is to substantially discharge a portion of a centripetal incident mechanical force from the colliding source by the release of the portion of the pressurized gas from the pressurizable and ventable sac before the centripetal incident mechanical force merges in phase with a centrifugal incident mechanical force from the victim's head inside the victim's head so as to reduce summation of in-phase bidirectional incident mechanical forces inside a brain tissue of the victim. A second aim of the configuration of the differential release is sequentially extend time of collision so as to maximize time extension of the collision. To that end, the three-layered shell of the present invention is configured to have a predetermined threshold of an average impact force based on a weight of a victim and an anticipated type of collision which determines velocity of the collision. The predetermined threshold of an average impact force is configured to correspond to a level of brain tissue injury by collision. The pressure-triggerable gas release valve of the pressurizable and ventable sac is configured by factory-adjustment of the resistance of the compression spring of the pressure-triggerable gas release valve to complete venting-out of a portion of the pressurized gas over the time of collision with the colliding source if the average impact force of the collision exceeds the predetermined threshold of the average impact force. If the resistance of the compression spring of the pressure-triggerable gas release valve remains constant, the number of the pressure-triggerable gas release valves becomes a changeable factor for the pressure-triggerable gas release valve. Similarly, the number of the air-release pin holes on the outer membrane of the block of the inner layer is configured by factory-adjustment to complete the release of the trapped air from the polymer foam of the block over the time of collision with the victim's head if the average impact force of the collision exceeds the predetermined threshold of the average impact force.

DETAILED DESCRIPTION OF THE DRAWINGS

As described below, the present invention provides a protective headgear having a multi-layered shell to sequentially extend time of collision of a blunt trauma to a human head and to differentially release an average impact force of the collision to the human head. It is to be understood that the descriptions are solely for the purposes of illustrating the present invention, and should not be understood in any way as restrictive or limited. Embodiments of the present invention are preferably depicted with reference to FIGS. 1 to 12, however, such reference is not intended to limit the present invention in any manner. The drawings do not represent actual dimension of devices, but illustrate the principles of the present invention.

Figure 1A:
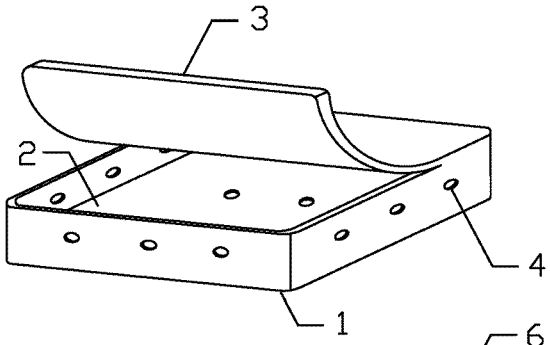
FIGS. 1A-1F show a schematic exploded view of individual components of the protective headgear.
Figure 1B:
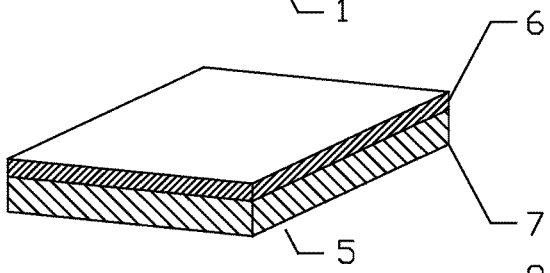
Figure 1C:
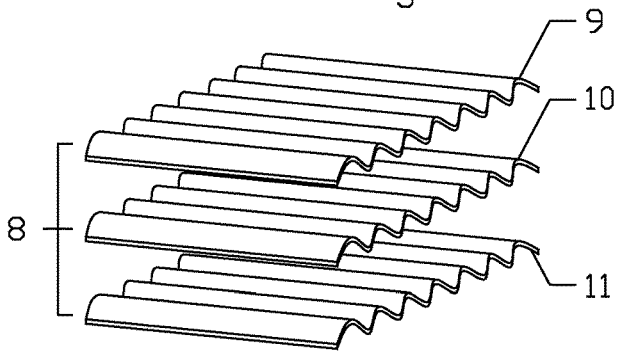

FIGS. 1A-1F show a schematic exploded view of individual components of the protective headgear. FIGS. 1A-1B show an inner layer comprising an outer polymeric membrane 1 shown in FIG. 1A that is configured to fixedly encase an individual block 5 of an inner layer shown in FIG. 1B inside a rectangular space 2. The rectangular space 2 is covered by a portion 3 of the outer membrane 1. On side walls of the outer membrane 1, a plurality of air-release pin holes 4 are provided, through which air moves in and out of the individual block 5 of the inner layer. The individual block 5 of FIG. 1B comprises a open-cell polymer foam provided in two adjoined panels, with an inner panel 6 having a foam support factor of >3.0 and an outer panel 7 having a foam support factor of between 1.5 and 3.0. A mid layer 8 shown in FIG. 1C is provided as a linearly corrugated plate and comprises an inner ply 9, a mid ply 10 and an outer ply 11. The inner ply 9 and the outer ply 11 are made of a hard polymer, and the mid ply 10 is made of a polymer foam. All three plies 9-11 are bonded tightly without a gap. An inner surface of the inner ply 9 is configured to reversibly enclose the inner layer of FIGS. 1A-1B. An outer surface of the outer ply 11 is configured to fixedly adhere to an outer layer of FIGS. 1D-1F.

Figure 1D:
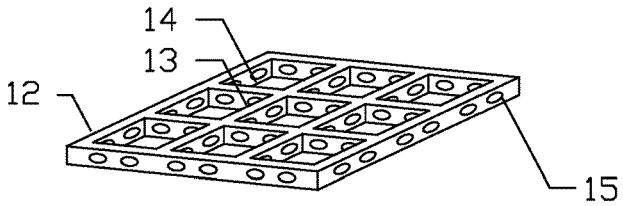
Figure 1E:
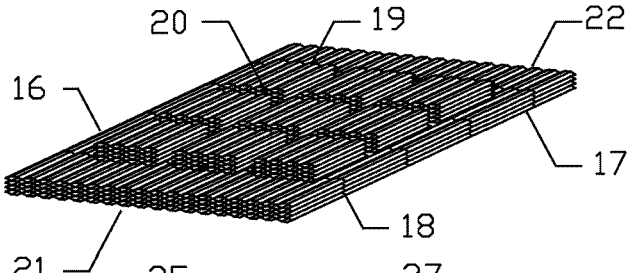
Figure 1F:
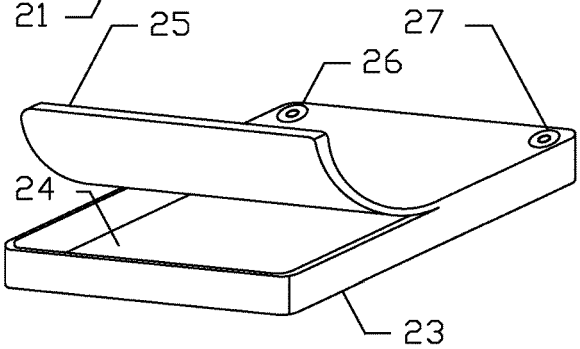

FIGS. 1D-1F illustrate components of the outer layer, comprising a polygonal grid 12 in FIG. 1D having a plurality of polygons 14, with each polygon surrounded by a protruding ridge 13. The protruding ridge 13 is perforated with a plurality of holes 15 intended to let free movement of a pressurized gas inside the outer layer. FIG. 1E shows a polymeric filling 16 comprising an outer panel 17 in a plate configuration adjoining an inner panel 19 in a criss-cross tiled configuration. The outer panel 17 is divided by a plurality of linear gaps 18 so as to let free movement of the pressurized gas in and out of the outer panel 17. Both longitudinal ends 21 and 22 of the outer panel 17 are connected coaxially in an open configuration. A linear groove 20 is disposed in between two adjacent planar tiles of the inner panel 19, and is configured to fixedly mate with the protruding ridge 13 of FIG. 1D. Shown in FIG. 1F, a pressurizable and ventable sac 23 is configured to fixedly encase the polymeric filling 16 and the polygonal grid 12 in a space 24 of the pressurizable and ventable sac 23, and to close air-tightly by an inner wall 25. FIG. 1F schematically shows a pressurized-gas intake valve 26 through which a pressurized gas is insufflated into the space 24 and a pressure-triggerable gas release valve 27 which is configured to vent out the pressurized gas from the space 24.

Figure 2:
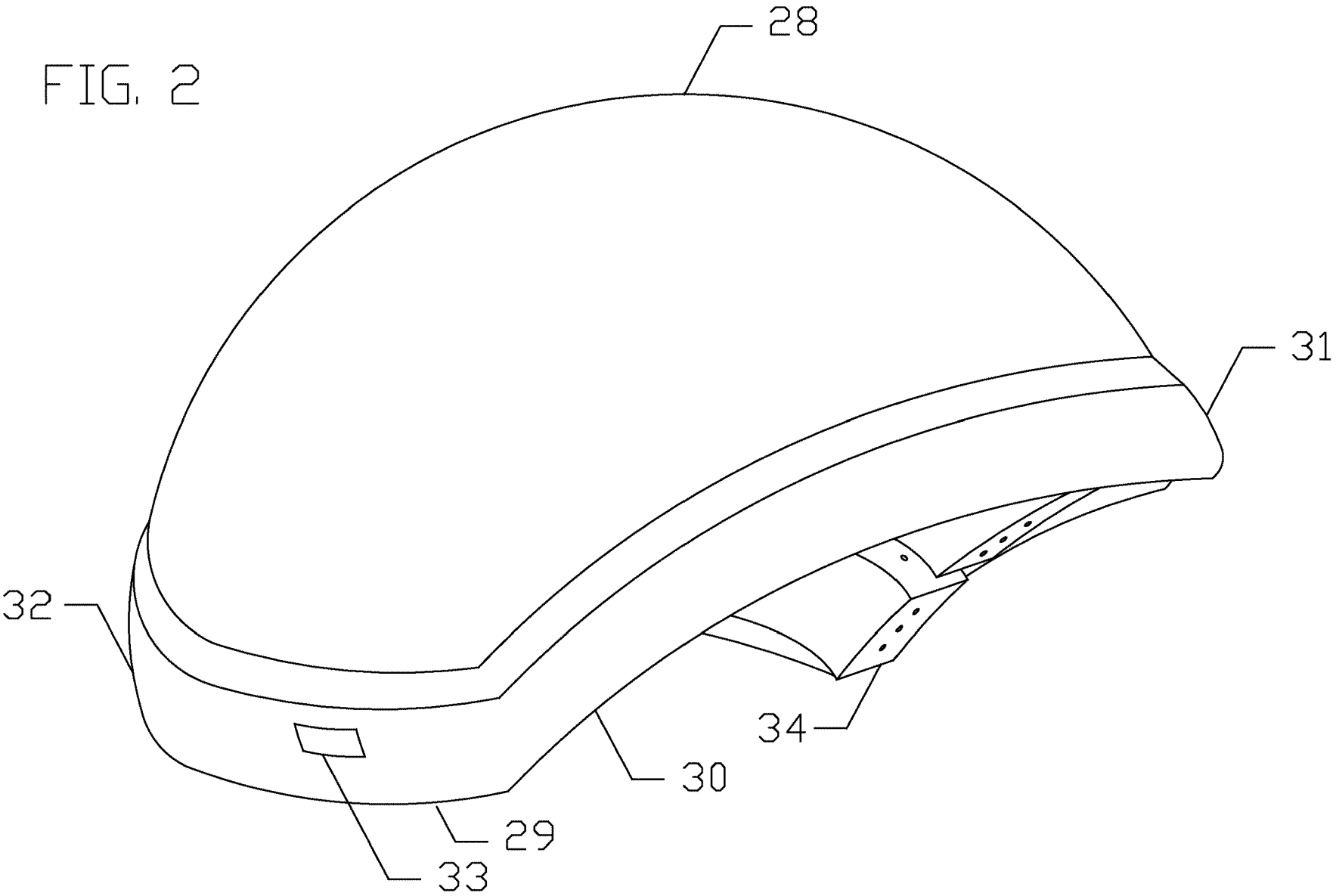
FIG. 2 represents a schematic example of an overall view of the protective headgear.

FIG. 2 shows a schematic presentation of the protective headgear which comprises a dome portion 28 covering the majority of a head including frontal, parietal, sphenoid, occipital and temporal regions of a human head, a lower circumferential ballooned rim 29 covering a portion of zygomatic arch and mastoid protuberance of the human head, and an inner layer 34. A frontal portion of the lower circumferential ballooned rim is shown as 31, an occipital portion 32 and a lateral portion 30. A pressure sensor device 33 is located on the lateral portion 30 of the lower circumferential ballooned rim 29, and is configured to monitor a gas pressure in the pressurizable and ventable sac and to generate sound alarm and flashing lights.

Figure 3A:
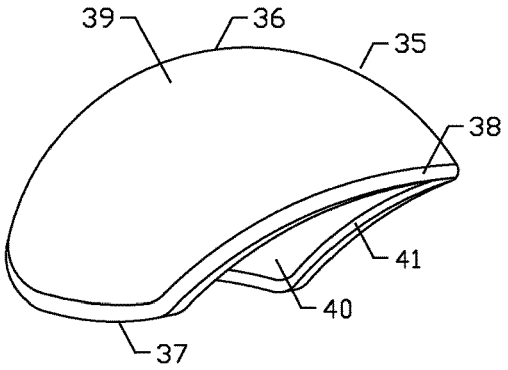
FIGS. 3A-3E illustrate a schematic exploded view of individual components of an outer layer.
Figure 3B:
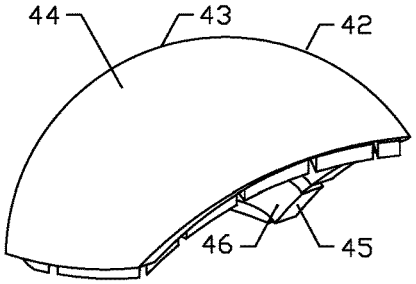
Figure 3C:
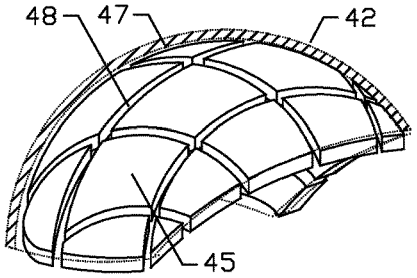
Figure 3D:
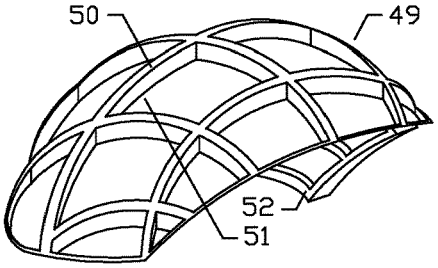
Figure 3E:
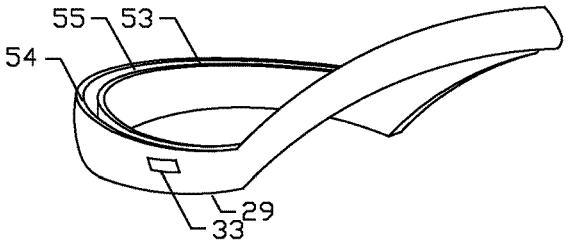

FIGS. 3A-3E illustrate a schematic exploded view of individual components of the outer layer. Shown in FIG. 3A, a hemispherical bowl portion 35 of the pressurizable and ventable sac having an outer surface 39 and an inner surface 40 comprises a dome portion 36, a lower circumferential border 37, an outer circumferential seam 38 and an inner circumferential seam 41. The lower circumferential border 37 is configured to be inserted in the lower circumferential ballooned rim shown in FIG. 3E. The outer and inner circumferential seams 38 and 41 are configured to fixedly adhered to an inner surface of an outer wall 54 and an inner surface of an inner wall 53 of the lower circumferential ballooned rim 29 of FIG. 3E, respectively, so as to produce an air tight chamber 55 of the pressurizable and ventable sac. FIG. 3B shows the polymeric filling 42 in a hemispherical bowl configuration comprising the outer panel 43 having an outer surface 44, and the inner panel 45 having an inner surface 46. FIG. 3C depicts a schematic see-through view of the polymeric filling 42 having a cross-sectional view 47 of the outer panel and a plurality of planar tiles of the inner panel 45 arranged in the criss-cross tiled configuration. A linear groove 48 is disposed in between two planar tiles of the inner panel 45. FIG. 3D shows the polygonal grid in a configuration of a hemispherical polyhedron 49 comprising a plurality of protruding ridges 50 bordering polygons 51. An inner part of the protruding ridge is shown as 52. Referring to FIGS. 3C and 3D, the polymeric filling 42 is fixedly combined with the hemispherical polyhedron 49 of the polygonal grid, wherein a plurality of the protruding ridges 50 mate with the linear groove 48, and a plurality of planar tiles of the inner panel 45 mate with the polygons 51. The polymeric filling 16 combined with the hemispherical polyhedron 49 of the polygonal grid is fixedly encased by the hemispherical bowl portion 35 of the pressurizable and ventable sac of FIG. 3A. The hemispherical bowl portion 35 of the pressurizable and ventable sac encasing the polymeric filling 16 combined with the hemispherical polyhedron 49 of the polygonal grid then is fixedly adhered to the lower circumferential ballooned rim shown in FIG. 3E, so as to produce the air tight chamber of the pressurizable and ventable sac. The pressure sensor device 33 is affixed to and protrudes through an inner wall of the lower circumferential ballooned rim 29.

Figure 4A:
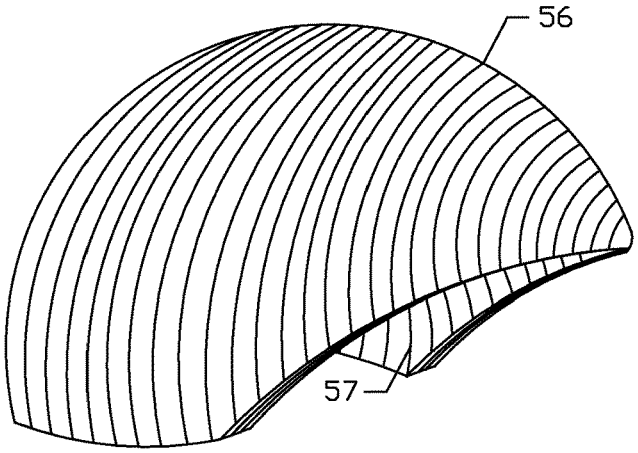
FIGS. 4A-4C illustrates a schematic example of a mid layer and patterns of induced interference with mechanical waves across the mid layer.
Figure 4B:
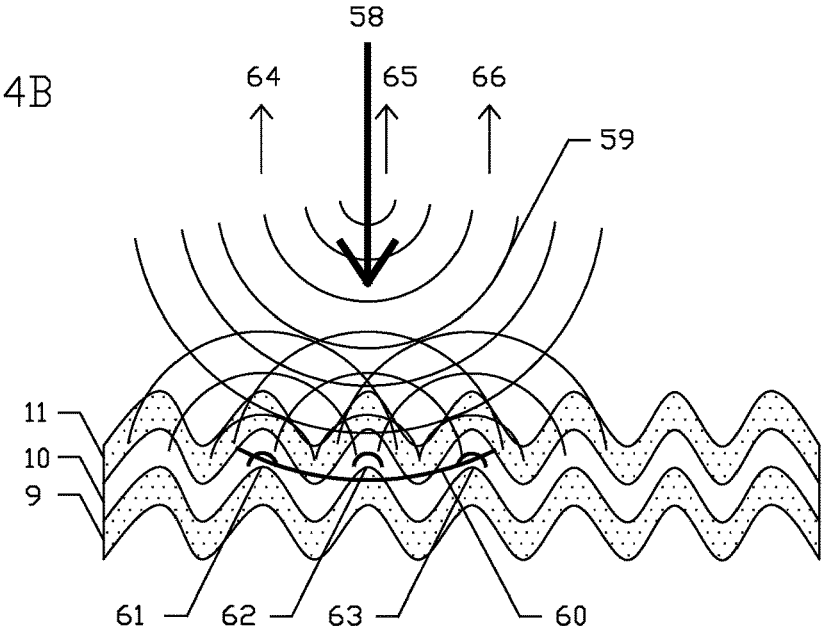

FIG. 4A illustrates a schematic example of a mid layer provided as a linearly corrugated plate in a hemispherical bowl configuration having ridges and furrows, showing an outer surface 56 of an outer ply and an inner surface 57 of an inner ply. The mid layer has a measurable thickness ranging from 0.1 inches to 1.0 inches. FIG. 4B depicts a schematic mechanistic example of an induced interference of centrifugal reflected mechanical waves 64-66 with centripetal incident/transmitted mechanical waves 59/60 coming from a colliding source across the mid layer upon a collision. The centripetal incident mechanical waves 59 of a centripetal mechanical force 58 are transmitted as centripetal transmitted mechanical waves 60 through the outer ply 11 to the mid ply 10, momentarily intensified in an amplitude as the hardness of the mid ply 10 is lower than that of the outer ply 11. The centripetal transmitted mechanical waves 60 are then reflected off ridges 61-63 to become the centrifugal reflected mechanical waves 64-66. A phase of the centrifugal reflected mechanical waves 64-66 becomes reversed from a phase of the centripetal transmitted mechanical waves 60 since the hardness of the inner ply 9 is higher than that of the mid ply 10. Thus, the phase-reversed centrifugal reflected mechanical waves 64-66 reduce the amplitude of successive centripetal transmitted mechanical waves 60 upon merging with the successive centripetal transmitted mechanical waves 60.

Figure 4C:
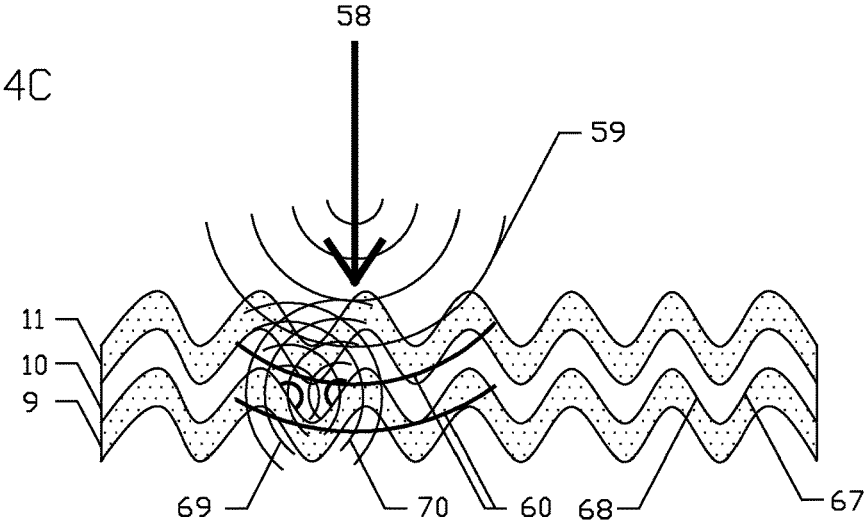

In FIG. 4C, the centripetal incident mechanical waves 59 of the centripetal mechanical force 58 are transmitted as centripetal transmitted mechanical waves 60 through the outer ply 11 to the mid ply 10, similar to a scenario shown in FIG. 4B. The centripetal transmitted mechanical waves 60 are then reflected off side walls 67-68 of furrows to become tangential reflected mechanical waves 69-70. A phase of the tangential reflected mechanical waves 69-70 becomes reversed from the phase of the centripetal transmitted mechanical waves 60, since the hardness of the inner ply 9 is higher than that of the mid ply 10. Thus, the phase-reversed tangential reflected mechanical waves 69-70 reduce the amplitude of successive centripetal transmitted mechanical waves 60 upon merging with the successive centripetal transmitted mechanical waves 60. Similar phenomena can be expected for centrifugal mechanical waves of a centrifugal mechanical force from a victim's head toward the mid ply of the protective headgear upon the collision. In short, bidirectional transmitted mechanical waves are reduced and diffused across the mid ply of the present invention.

Figure 5A:
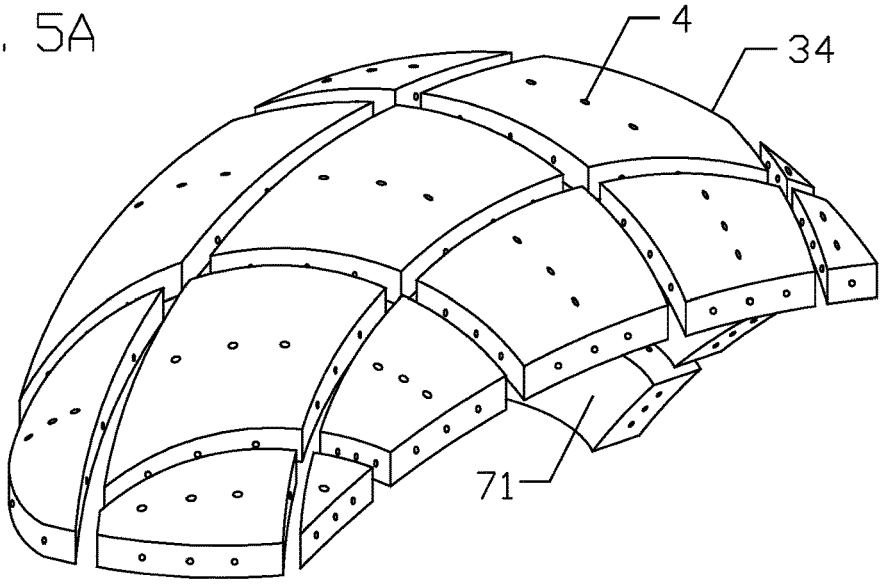
FIGS. 5A-5B illustrate a schematic example of an inner layer.
Figure 5B:
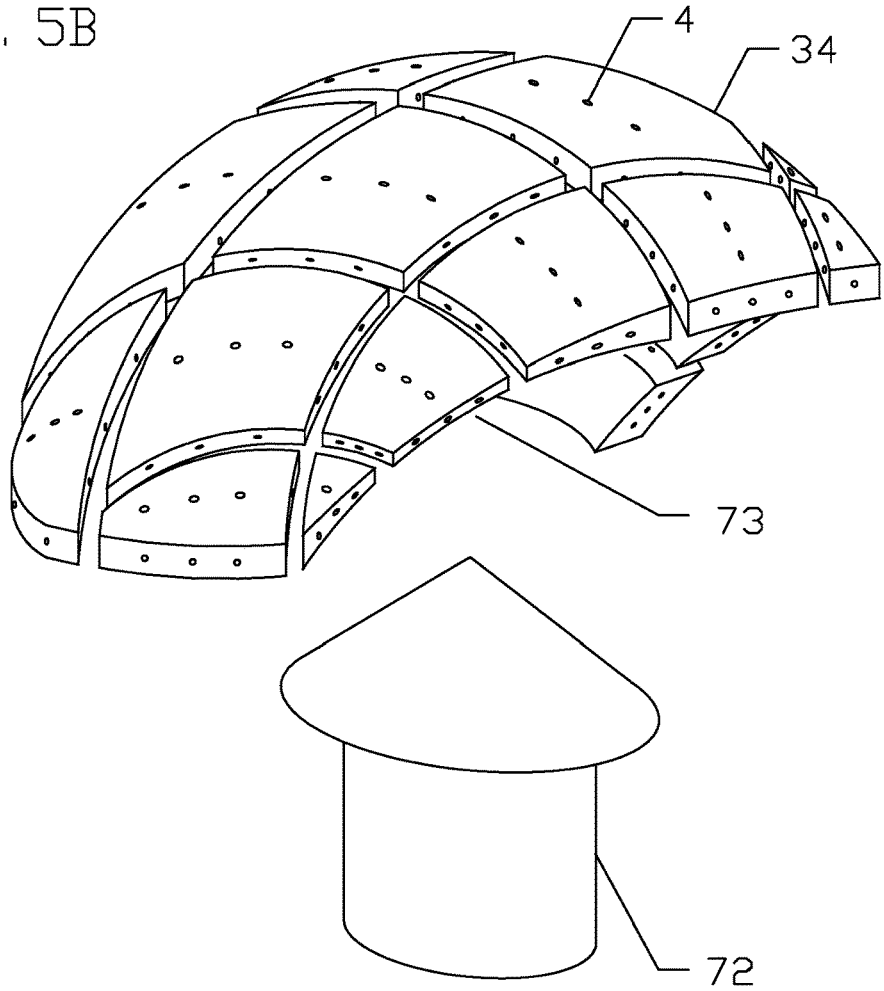

FIG. 5A illustrates a schematic example of an inner layer 34 provided as a plurality of blocks in a criss-cross tiled configuration. Referring to FIG. 1A, a plurality of air-release pin holes 4 are provided on an outer membrane of the blocks. An inner surface 71 of the inner layer is configured to reversibly cover a human head. FIG. 5B illustrates a schematic example of a centrifugal compression 73 of the inner layer by a centrifugal force 72 upon a collision. The centrifugal compression of the inner layer is associated with release of trapped air through a plurality of air-release pin holes 4.

Figure 6A:
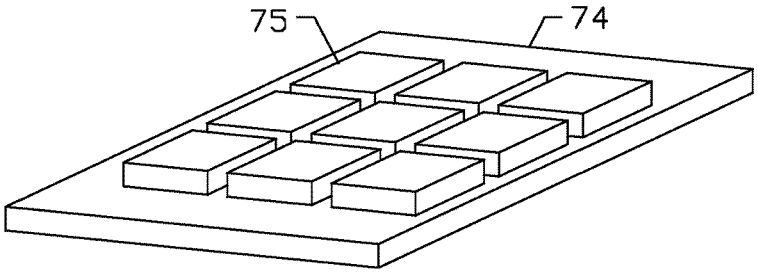
FIGS. 6A-6C depict a schematic view of a compressible polymeric foam air-tightly enclosed by a pressurizable and ventable sac of the outer layer.
Figure 6B:
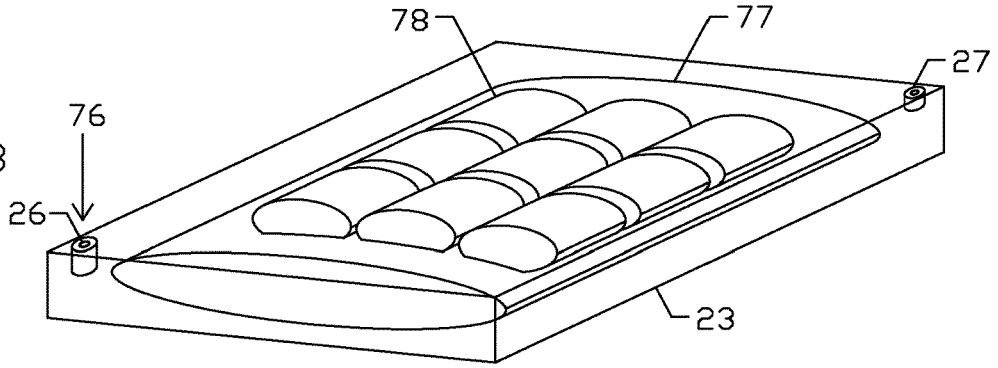
Figure 6C:
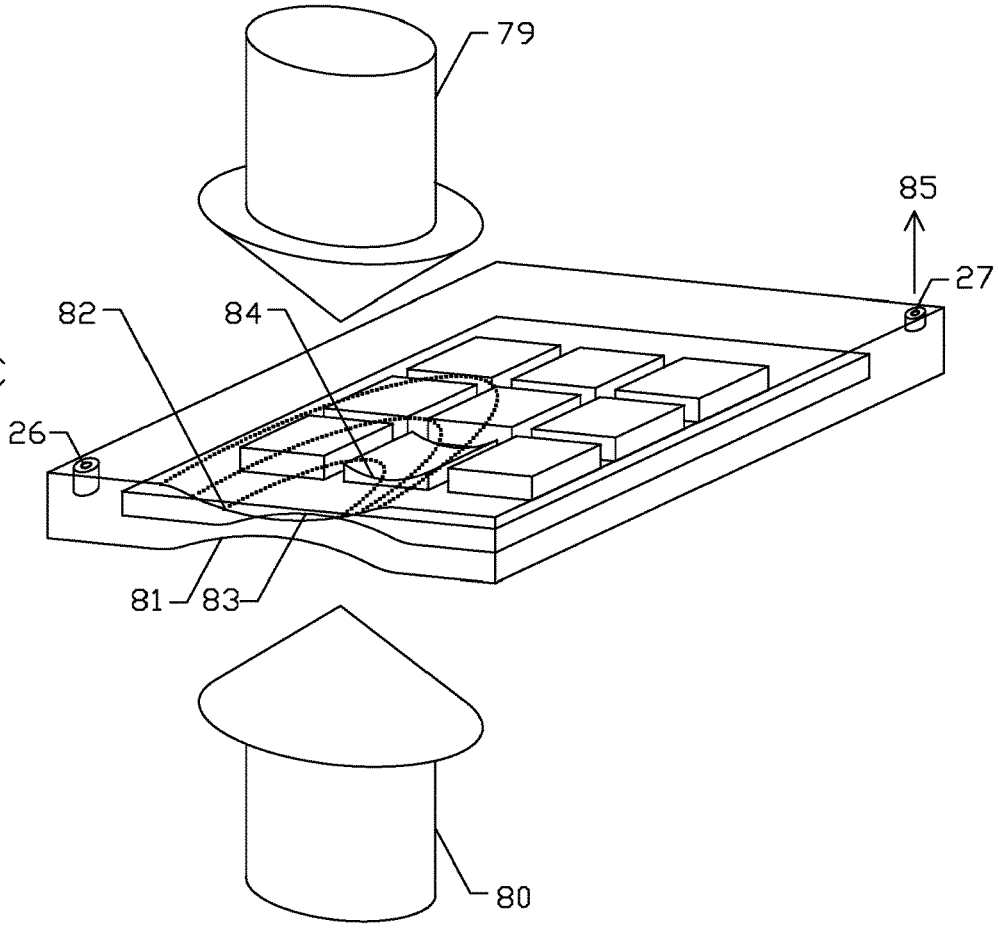

FIGS. 6A-6C depict a schematic example of a portion of a polymeric filling having a compressible and deformable open-cell polymer foam filling up inside the pressurizable and ventable sac. The polymeric filling comprises an outer panel 74 in a plate configuration and an inner panel 75 having a plurality of planar tiles arranged in a criss-cross tiled configuration. An outer membrane 23 of the pressurizable and ventable sac fixedly and air-tightly encloses the outer panel and the inner panel of the compressible and deformable open-cell polymer foam. A pressurized gas 76 can be insufflated through the pressurized-gas intake valve 26 into the pressurizable and ventable sac up to a set limit of gas pressure for release of the pressurized gas through the pressure-triggerable gas release valve 27, flexibly inflating the outer panel to an outer panel 77 in a distended configuration and the inner panel to an inner panel 78 in a distended configuration. FIG. 6C illustrates a schematic example of a planar compression upon a collision, of the pressurizable and ventable sac having the compressible and deformable open-cell polymer foam. A centripetal mechanical force 79 and a centrifugal mechanical force 80 are generated by the collision, each moving at an angle to the pressurizable and ventable sac and compressing an area 81-82 of the pressurizable and ventable sac. Simultaneously, a portion of the outer panel 83 and a portion of the inner panel 84 are compressed, releasing a portion of trapped pressurized gas 85 inside the portion of the outer panel and the inner panel out through the pressure-triggerable gas release valve 27. Re-insufflation of pressurized gas restores an original shape and pressure of the pressurizable and ventable sac.

Figure 7A:
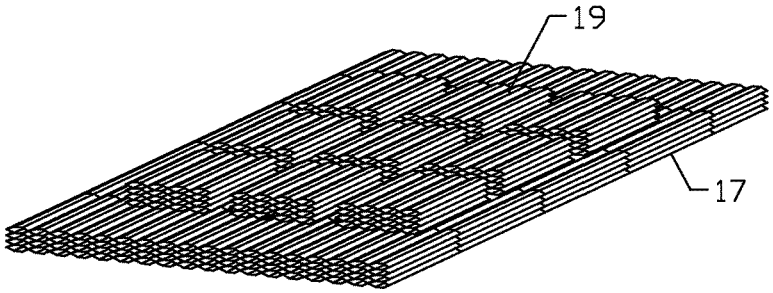
FIGS. 7A-7D shows a schematic illustration of a concentrically stacked-up polymeric tubes air-tightly enclosed by a pressurizable and ventable sac of the outer layer.
Figure 7B:
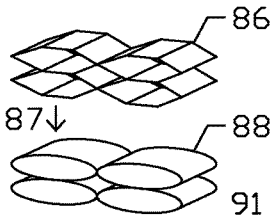
Figure 7C:
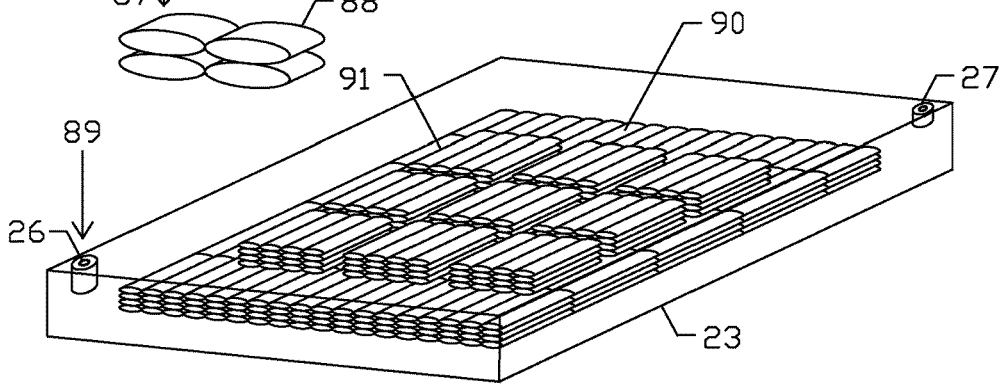
Figure 7D:
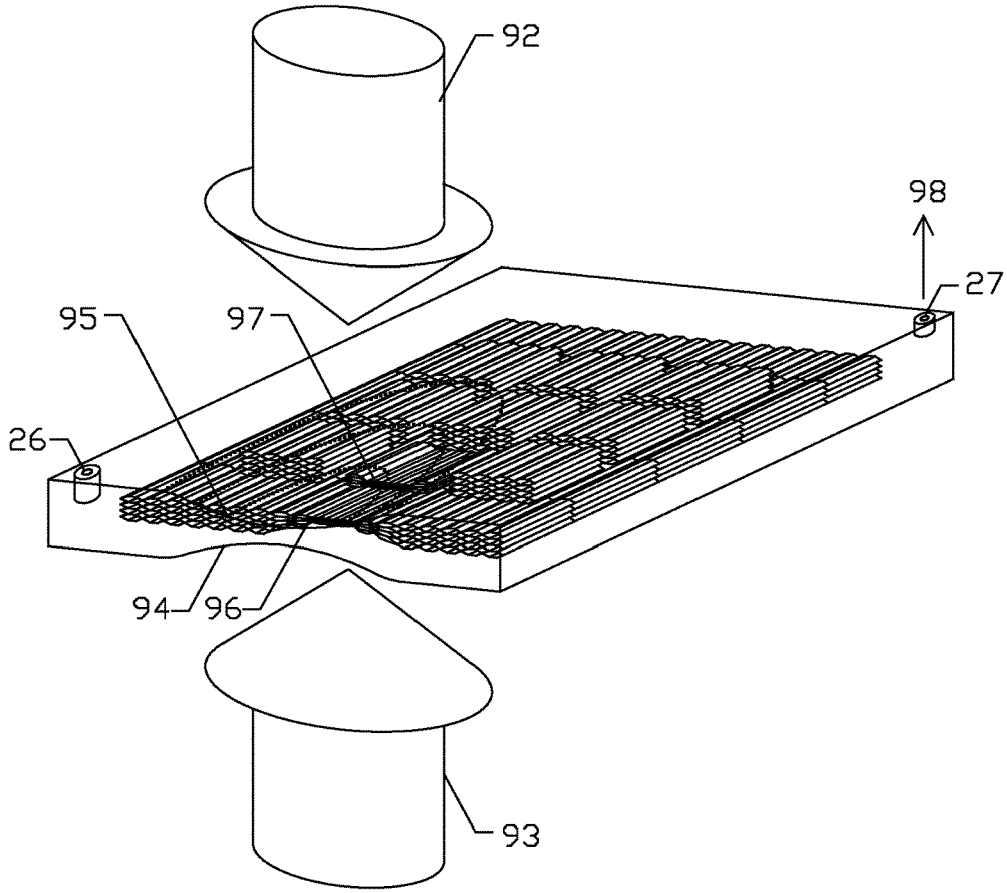

FIGS. 7A-7D shows a schematic illustration of a portion of a polymeric filling having a concentrically stacked-up polymeric tubes air-tightly enclosed by a pressurizable and ventable sac of the outer layer. Shown in FIG. 7A, the polymeric filling comprises the outer panel 17 in a plate configuration and the inner panel 19 having a plurality of planar tiles arranged in a criss-cross tiled configuration. FIG. 7B shows the concentrically stacked-up polymer tubes arranged in a way each polymer tube 86 adjoins the other polymer tube in parallel along a longitudinal axis of the polymer tube. The polymeric tube 86 is configured to be strechably distended to a distended configuration 88 by insufflation of a pressurized gas 87. FIG. 7C schematically shows the outer panel 90 and the planar tiles 91 of the inner panel in the distended configuration by a pressurized gas 89 through the pressurized-gas intake valve 26 inside the outer membrane 23 of the pressurizable and ventable sac up to a set limit of gas pressure for release of the pressurized gas through the pressure-triggerable gas release valve 27. FIG. 7D illustrates a schematic example of a planar compression upon a collision, of the pressurizable and ventable sac having the concentrically stacked-up polymeric tubes. A centripetal mechanical force 92 and a centrifugal mechanical force 93 are generated by the collision, each moving at an angle to the pressurizable and ventable sac and compressing an area 94-95 of the pressurizable and ventable sac. Simultaneously, a portion of the outer panel 96 and a portion of the inner panel 97 are compressed, releasing a portion of trapped pressurized gas 98 inside the portion of the outer panel and the inner panel out through the pressure-triggerable gas release valve 27. Re-insufflation of pressurized gas restores an original shape and pressure of the pressurizable and ventable sac.

Figure 8:
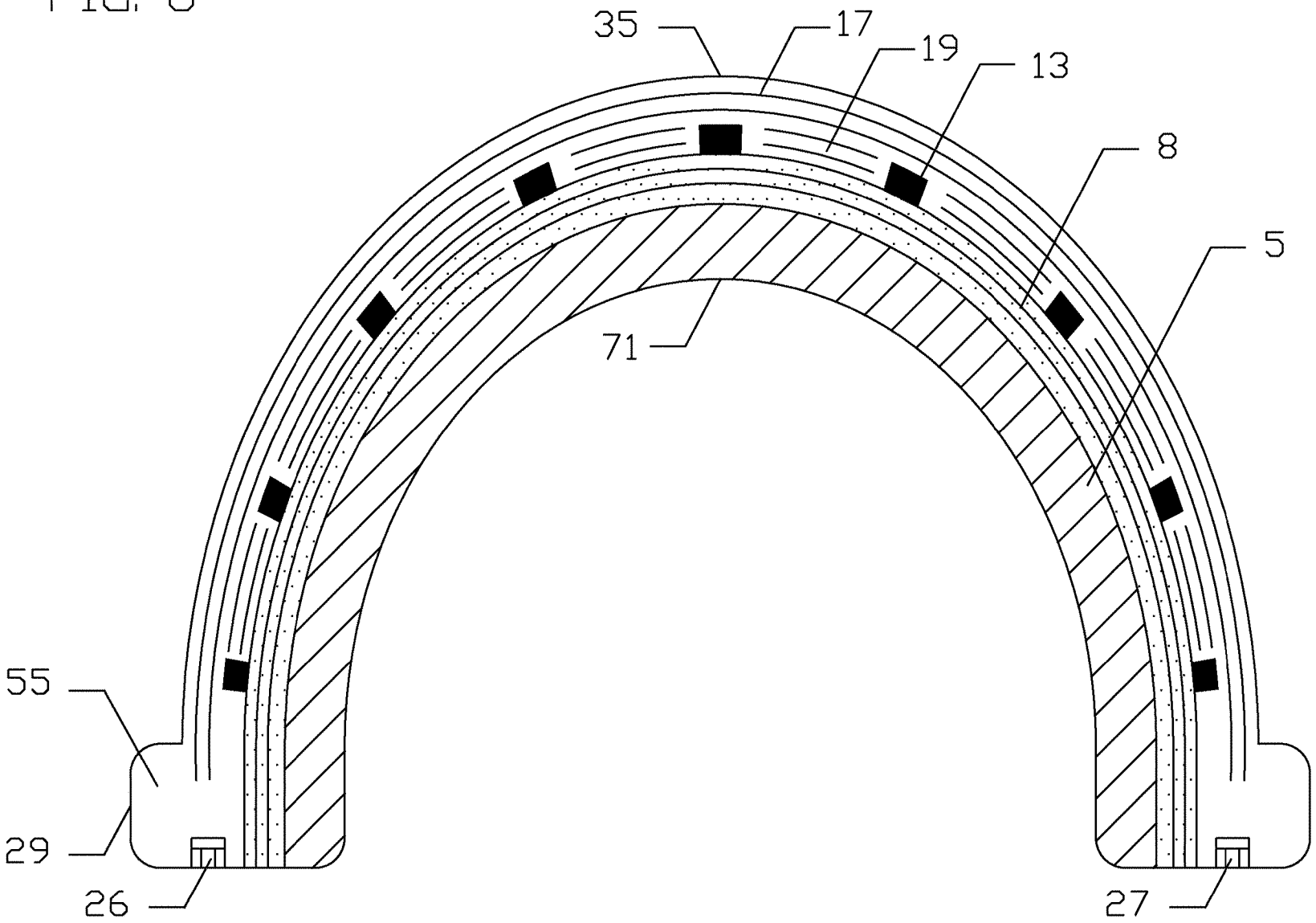
FIG. 8 shows a schematic example of a coronal view of the protective headgear.

FIG. 8 shows a schematic example of a coronal view of stacked-up layers of the three-layered shell of the protective headgear. The outer layer having the pressurizable and ventable sac comprises the hemispherical bowl portion 35 of the outer layer, the outer panel 17, the inner panel 19 and the polygonal grid 13. The hemispherical bowl portion 35 is fixedly connected to the lower circumferential ballooned rim 29 of the outer layer having the air tight chamber 55. Schematically drawn, the pressurized-gas intake valve 26 and the pressure-triggerable gas release valve 27 are disposed thereof on a lower wall of the lower circumferential ballooned rim 29 having the air tight chamber 55. The inner layer 5 having the inner surface 71, configured in a hemispherical bowl shape so as to accommodate a dome shaped human head, is reversibly enclosed by the mid layer 8. The mid layer 8, provided in a hemispherical-bowl configuration, is fixedly adhered to an inner surface of the outer layer.

Figure 9:
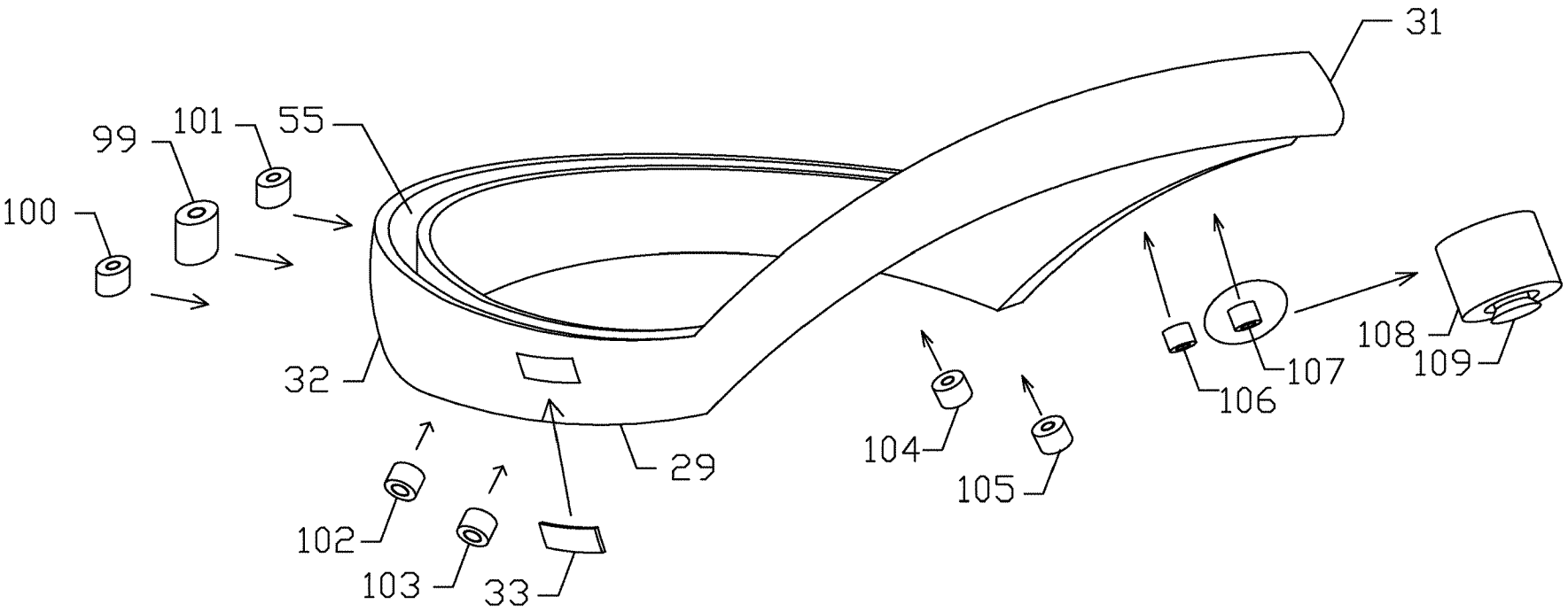
FIG. 9 shows a schematic example of individual components of a lower circumferential ballooned rim of the pressurizable and ventable sac.

FIG. 9 shows a schematic example of individual components of the lower circumferential ballooned rim 29 of the pressurizable and ventable sac having the frontal portion 31 and the occipital portion 32. A Schrader-type gas intake valve 99 is embedded in the lower wall of the lower circumferential ballooned rim 29 below the occipital portion 32 into the air tight chamber 55. A plurality of pressure-triggerable gas release valves 100-107 are embedded in the lower wall of the lower circumferential ballooned rim 29. One frontal pressure-triggerable gas release valve 107 is shown magnified, having a cylindrical configuration with an outer cylinder 108 and a quick-release valve 109 which is pushable by a spring. The pressure sensor device 33 is located above the lateral portion of the lower circumferential ballooned rim.

Figure 10A:
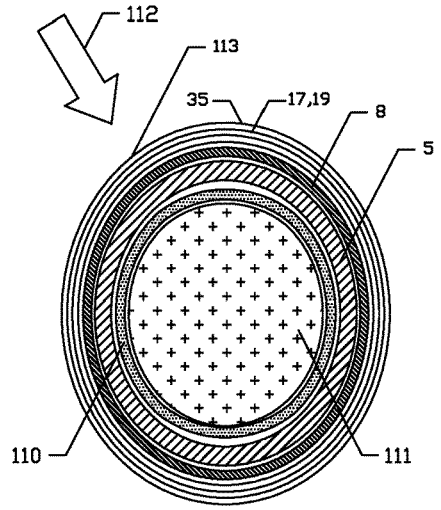
FIGS. 10A-10C illustrate a schematic example of a sequence of a collision above a predetermined threshold of an average impact force to a human head wearing the protective headgear.
Figure 10B:
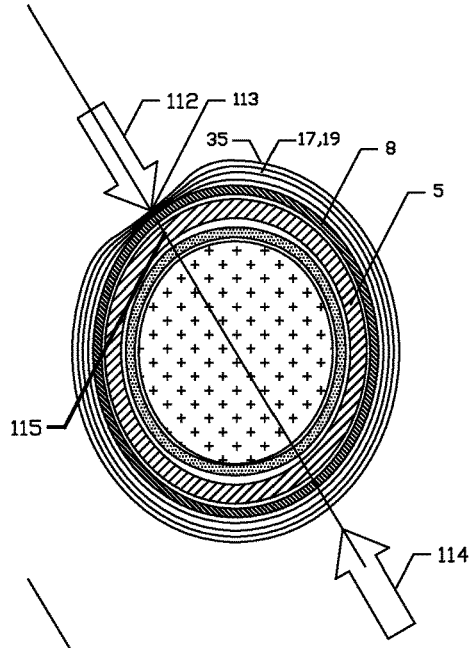
Figure 10C:
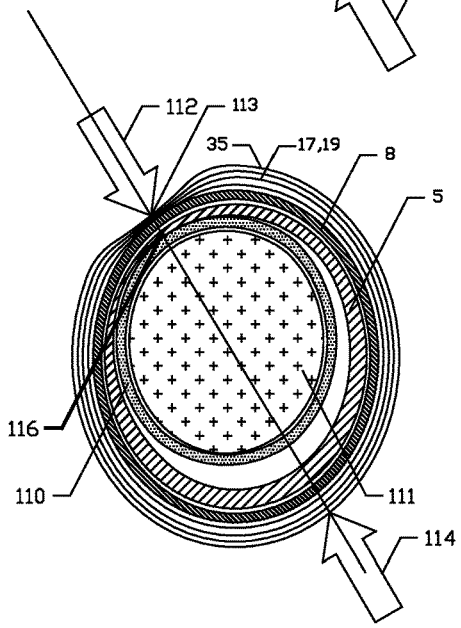

FIGS. 10A-10C illustrate a schematic example of a sequence of a collision above a predetermined threshold of an average impact force to a human head wearing the protective headgear. Shown in FIG. 10A, a human head comprising a skull 110 and a brain tissue 111 is enclosed in the protective headgear comprising the hemispherical bowl portion 35 of the outer layer having the outer panel 17 and the inner panel 19 enclosed inside the pressurizable and ventable sac, the mid layer 8 and the inner layer 5. A centripetal incident mechanical force 112 from a collision with a colliding source above a predetermined threshold of an average impact force is about to be delivered to a site 113 of the outer layer of the protective headgear. Immediately upon the collision shown in FIG. 10B, the centripetal incident mechanical force 112 above a predetermined threshold of an average impact force compresses the outer panel 17 and the inner panel 19 enclosed inside the pressurizable and ventable sac, and completes release of a portion of a pressurized gas from the pressurizable and ventable sac through the pressure-triggerable gas release valves as shown in FIGS. 6-7 over a time of the collision before a portion 115 of the inner layer 5 in an uncompressed configuration located along a longitudinal axis of the centripetal incident mechanical force 112 completes full compression by a centrifugal mechanical force 114 from the head and consequent release of a trapped air from a polymer foam of the inner layer 5 as shown in FIGS. 1B and 5B. Following the completion of the release of the pressurized gas from the pressurizable and ventable sac of the outer layer over the time of the collision shown in FIG. 10B, the centrifugal mechanical force 114 completes the full compression 116 and the release of the trapped air from the portion of the inner layer over a time of the collision, shown in FIG. 10C. A rate of release of the portion of the pressurized gas from the pressurizable and ventable sac is configured to complete the release of the pressurized gas upon the collision over a time of the collision before completion of the release of the trapped air from the portion of the inner layer over a time of the collision. Referring to FIGS. 1F, 6-7 and 9, a rate of the release of the portion of the pressurized gas from the pressurizable and ventable sac is regulated by a resistance level of a compression spring of the pressure-triggerable gas release valves and a number of the pressure-triggerable gas release valves of the pressurizable and ventable sac. Referring to FIGS. 1A and 5, a rate of the release of the trapped air from the portion of the inner layer is regulated by a number of the air-release pin holes disposed on the outer membrane of the blocks of the inner layer. The protective headgear of the present invention is configured with a faster rate of the release of the portion of the pressurized gas from the pressurizable and ventable sac than a rate of the release of the trapped air from the portion of the inner layer.

Figure 11A:
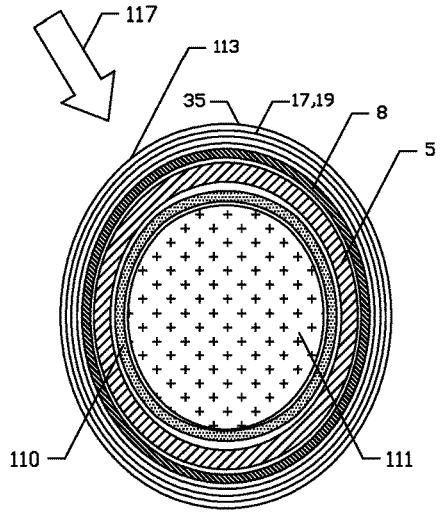
FIGS. 11A-11C show a schematic example of a sequence of a collision near the predetermined threshold of the average impact force to the human head wearing the protective headgear.
Figure 11B:
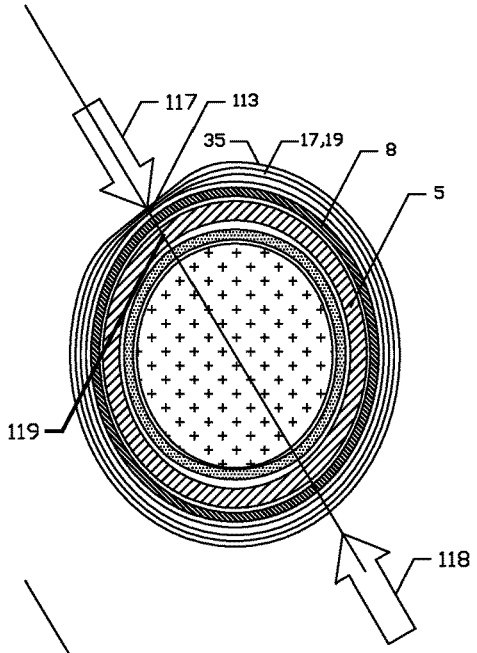
Figure 11C:
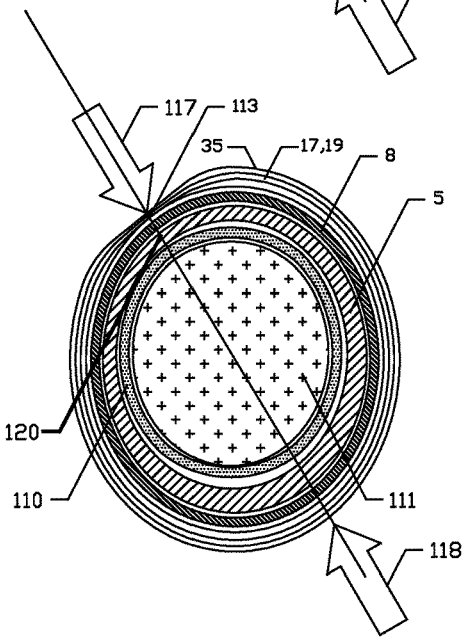

FIGS. 11A-11C show a schematic example of a sequence of a collision near the predetermined threshold of the average impact force to the human head wearing the protective headgear. Shown in FIG. 11A, the human head comprising the skull 110 and the brain tissue 111 is enclosed in the protective headgear comprising the hemispherical bowl portion 35 of the outer layer having the outer panel 17 and the inner panel 19 enclosed inside the pressurizable and ventable sac, the mid layer 8 and the inner layer 5. A centripetal incident mechanical force 117 from a collision with a colliding source near the predetermined threshold of the average impact force is about to be delivered to the site 113 of the outer layer of the protective headgear. Shown in FIG. 11B, immediately upon the collision, the centripetal incident mechanical force 117 compresses the outer panel 17 and the inner panel 19 enclosed inside the pressurizable and ventable sac, and completes release of a pressurized gas from the pressurizable and ventable sac through the pressure-triggerable gas release valves as shown in FIGS. 6-7 over a time of the collision. A centrifugal mechanical force 118 is generated from the head toward the centripetal mechanical force 117, yet an average impact force of the centrifugal mechanical force 118 is unable to complete compression of a portion 119 of the inner layer with consequent release of the trapped air from the polymer foam of the inner layer over a time of the collision. Shown in FIG. 11C, there remains a partially compressed portion 120 of the inner layer at the end of the time of the collision.

Figure 12A:
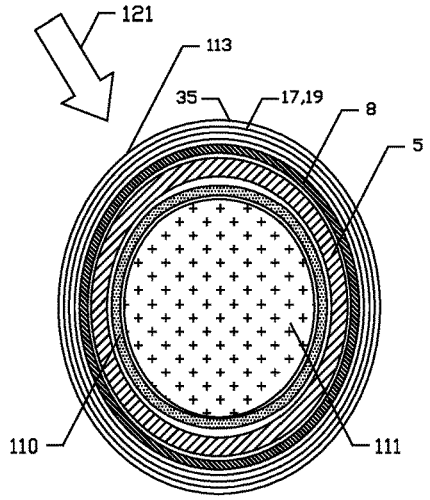
FIGS. 12A-12C show a schematic example of a sequence of a collision below the predetermined threshold of the average impact force to the human head wearing the protective headgear.
Figure 12B:
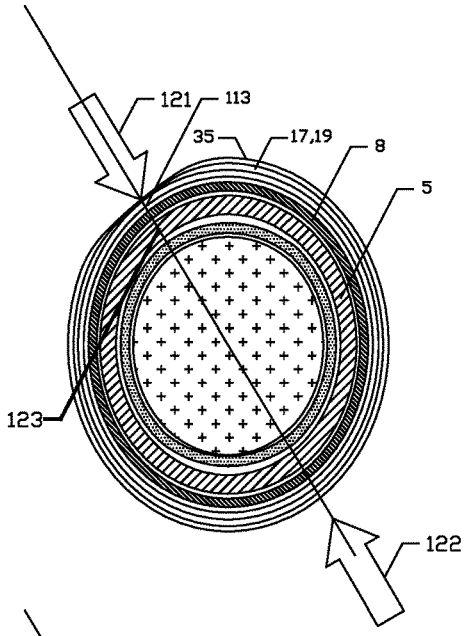
Figure 12C:
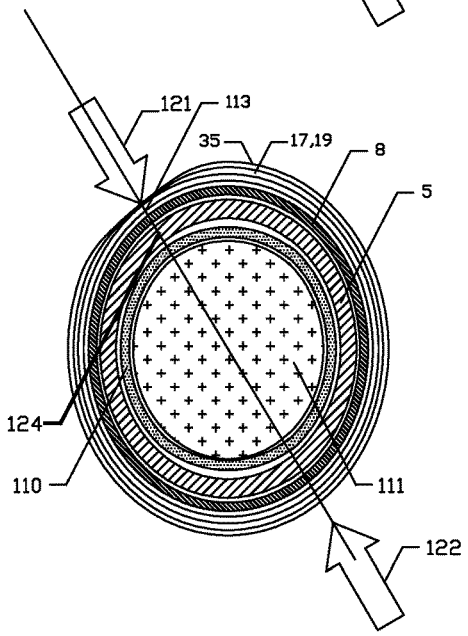

FIGS. 12A-12C show a schematic example of a sequence of a collision below the predetermined threshold of the average impact force to the human head wearing the protective headgear. Shown in FIG. 12A, the human head comprising the skull 110 and the brain tissue 111 is enclosed in the protective headgear comprising the hemispherical bowl portion 35 of the outer layer having the outer panel 17 and the inner panel 19 enclosed inside the pressurizable and ventable sac, the mid layer 8 and the inner layer 5. A centripetal incident mechanical force 121 from a collision with a colliding source below the predetermined threshold of the average impact force is about to be delivered to the site 113 of the outer layer of the protective headgear. Shown in FIG. 12B, immediately upon the collision, the centripetal incident mechanical force 121 compresses the outer panel 17 and the inner panel 19 enclosed inside the pressurizable and ventable sac, and completes release of a pressurized gas from the pressurizable and ventable sac through the pressure-triggerable gas release valves as shown in FIGS. 6-7 over a time of the collision. A centrifugal mechanical force 122 is generated from the head toward the centripetal mechanical force 121, yet an average impact force of the centrifugal mechanical force 122 is unable to initiate compression of a portion 123 of the inner layer over a time of the collision. At the end of the time of the collision, there remains an uncompressed portion 124 of the inner layer, shown in FIG. 12C.

It is to be understood that the aforementioned description of the protective headgear is simple illustrative embodiments of the principles of the present invention. Various modifications and variations of the description of the present invention are expected to occur to those skilled in the art without departing from the spirit and scope of the present invention. Therefore the present invention is to be defined not by the aforementioned description but instead by the spirit and scope of the following claims.

What is claimed is:

1. A protective headgear, comprising:

a three-layered shell comprising an outer layer having a pressurizable and ventable sac, a mid layer provided as a linearly corrugated plate, and an inner layer having a plurality of air-release pin holes;

the outer layer, provided as a compressible and deformable layer in a hemispherical bowl configuration, wherein the outer layer comprises the pressurizable and ventable sac fixedly adjoining a lower circumferential ballooned rim, a polymeric filling filling up the pressurizable and ventable sac, and a polygonal grid in a hemispherical polyhedron configuration enclosed by the pressurizable and ventable sac;

the pressurizable and ventable sac, provided in a hemispherical bowl configuration, wherein the pressurizable and ventable sac comprises a pressurized-gas intake valve and a plurality of pressure-triggerable gas release valves;

the mid layer, provided as the linearly corrugated plate in a hemispherical bowl configuration, wherein the mid layer is fixedly adhered to an inner surface of the outer layer; and the inner layer, wherein the inner layer comprises an outer membrane having a plurality of the air-release pin holes disposed therethrough the outer membrane, wherein the outer membrane is configured to tightly enclose a plurality of compressible and deformable blocks of open-cell polymer foam, and wherein the inner layer is configured to be reversibly adhered to an inner surface of the mid layer.

2. The protective headgear according to claim 1, further comprising:

the outer layer, wherein the outer layer is configured to be compressed and deformed by a collision with a colliding source at an angle to a planar surface of the outer layer over a time of the collision.

3. The protective headgear according to claim 1, further comprising:

the polymeric filling, wherein the polymeric filling is configured to be distensible inside the pressurizable and ventable sac by a pressurized gas insufflated into the pressurizable and ventable sac, wherein the polymeric filling is configured to be compressed and deformed by the collision with the colliding source over the time of the collision, and wherein the polymeric filling is configured to release the pressurized gas through the pressure-triggerable gas release valves of the pressurizable and ventable sac upon the collision over the time of the collision.

4. The protective headgear according to claim 1, further comprising:

the polygonal grid, wherein the polygonal grid is configured to be fixedly embedded in the polymeric filling of the outer layer.

5. The protective headgear according to claim 1, further comprising:

the pressurizable and ventable sac, wherein the pressurizable and ventable sac is configured to release the pressurized gas through the pressure-triggerable gas release valves upon the collision over the time of the collision.

6. The protective headgear according to claim 5, further comprising:

the pressure-triggerable gas release valve, wherein the pressure-triggerable gas release valve comprises a compression spring so as to release the pressurized gas upon the collision over the time of the collision, and wherein the compression spring of the pressure-triggerable gas release valve is configured to provide a range of resistance to an axial compressive pressure of the pressurized gas inside the pressurizable and ventable sac.

7. The protective headgear according to claim 5, further comprising:

the pressurizable and ventable sac, wherein the pressurizable and ventable sac is configured with a faster rate of a release of a portion of the pressurized gas through a plurality of the pressure-triggerable gas release valves upon the collision over the time of the collision than a rate of a release of a portion of a trapped air from the inner layer through a plurality of the air-release pin holes of the outer membrane upon the collision over the time of the collision.

8. The protective headgear according to claim 1, further comprising:

the linearly corrugated plate of the mid layer, wherein the linearly corrugated plate comprises an outer ply, a mid ply and an inner ply, wherein the outer ply and the inner ply comprise a hard thermoplastic polymer, wherein the mid ply comprises a polymer foam having a lower hardness than that of the outer and inner plies, and wherein the three plies are configured to be tightly bonded together so as to impart a Rockwell R value of higher than 140 to the linearly corrugated plate.

9. The protective headgear according to claim 8, further comprising:

the linearly corrugated plate of the mid layer, wherein the linearly corrugated plate is configured to be undeformable by the collision at an angle to a planar surface of the linearly corrugated plate.

10. The protective headgear according to claim 8, further comprising:

the linearly corrugated plate of the mid layer, wherein the linearly corrugated plate comprises a plurality of ridges and furrows, and wherein the linearly corrugated plate is configured to reduce and diffuse bidirectional transmitted mechanical waves moving across a plurality of the ridges and the furrows of the linearly corrugated plate.

11. The protective headgear according to claim 1, further comprising:

the compressible and deformable block of the open-cell polymer foam enclosed by the outer membrane of the inner layer, wherein the compressible and deformable block of the open-cell polymer foam enclosed by the outer membrane is configured to have a lower hardness than that of a human skull.

12. The protective headgear according to claim 1, further comprising:

the outer membrane of the inner layer, wherein the outer membrane is configured to release the portion of the trapped air inside the outer membrane through a plurality of the air-release pin holes to an ambient air upon the collision over the time of the collision.

13. The protective headgear according to claim 12, further comprising:

the outer membrane of the inner layer, wherein the outer membrane is configured with a slower rate of the release of the portion of the trapped air inside the outer membrane through a plurality of the air-release pin holes over the time of the collision than the rate of the release of the portion of the pressurized gas through a plurality of the pressure-triggerable gas release valves of the pressurizable and ventable sac over the time of the collision.

* * * * *